US006085810A

United States Patent [19]

Castillo et al.

[11] Patent Number: 6,085,810

[45] Date of Patent: Jul. 11, 2000

[54] CONTINUOUS SANDBAG-FORMING APPARATUS AND METHOD

[76] Inventors: Michael S. Castillo, 2138 Via Teca, San Clemente, Calif. 92673; Stephen Scott Williams, 31 Calle Bella, Rancho Santa Margarita, Calif. 92688

[21] Appl. No.: 09/186,823

[22] Filed: Nov. 5, 1998

[51] Int. Cl.[7] ..... B65B 1/04

[52] U.S. Cl. ..... 141/391; 141/313; 141/114; 53/576

[58] Field of Search ..... 141/114, 392, 141/313–319, 391; 53/576, 567, 577; 383/37; 405/15–20

[56] References Cited

U.S. PATENT DOCUMENTS

| | | | |
|---|---|---|---|
| 3,425,228 | 2/1969 | Lamberton | 61/38 |
| 3,524,320 | 8/1970 | Turzillo | 61/38 |
| 3,781,182 | 12/1973 | Friedman | 161/5 |
| 3,786,640 | 1/1974 | Turzillo | 61/37 |
| 3,895,929 | 7/1975 | Jysky et al. | 53/576 |
| 3,957,098 | 5/1976 | Hepworth et al. | 150/9 |
| 4,044,525 | 8/1977 | Forsgren | 53/576 |
| 4,184,788 | 1/1980 | Colle | 405/19 |
| 4,449,847 | 5/1984 | Scales et al. | 405/19 |
| 4,502,815 | 3/1985 | Scales et al. | 405/17 |
| 4,592,675 | 6/1986 | Scales et al. | 405/19 |
| 4,690,585 | 9/1987 | Holmberg | 405/19 |
| 4,824,285 | 4/1989 | Trierweiler | 405/17 |
| 5,669,732 | 9/1997 | Truitt | 405/20 |

*Primary Examiner*—Steven O. Douglas
*Attorney, Agent, or Firm*—Stetina Brunda Garred & Brucker

[57] ABSTRACT

A sandbag filler assembly for attachment to an axially movable filler-material source container. The assembly includes a filler chute for delivery of filler material into the sandbag, with the chute having a first open end and a second open end opposite the first end. The first open end has an attachment connection connectable to be in flow communication with a delivery conduit of the source container. An axially compressible sandbag, open at one end and closed at an opposite end, is placeable in a compressed configuration around the filler chute such that the filler chute is within the sandbag with the closed end of the sandbag generally adjacent the second open end of the filler chute. An adjustable sandbag retainer is provided for selective retention and release of the sandbag from around the filler chute as the sandbag has introduced therein filler material to thereby cause sequential movement of sandbag segments from the filler chute. Coordination of filler-material flow rate with source-container velocity can result in substantially continuous rapid and semi-automatic production of filled sandbags of selected lengths which can be produced on-site to immediately follow surface topography and effectively render water invasion protection.

15 Claims, 3 Drawing Sheets

CONTINUOUS SANDBAG-FORMING APPARATUS AND METHOD

FIELD OF THE INVENTION

This invention relates in general to filled sandbag production, and in particular to an apparatus and method for filled sandbag production employing a continuous length of an axially compressed sandbag disposed about the exterior of a filler chute such that the filler chute is within the sandbag for filler material introduction from an axially movable filler-material source container to thereby continuously form a length of sandbag by moving the filler-material source container while releasing segments of the axially compressed sandbag from the exterior of the filler chute.

BACKGROUND OF THE INVENTION

Perhaps the most commonly used product for attempted prevention of water damage during flooding conditions is a sandbag. Typically, a conventional sandbag is tubular in shape, is closed at one end, is about two to three feet in length, and is fabricated of a synthetic burlap material. Empty sandbags generally are supplied to a site where a pile of sand or similar filler material is located, and workers use shovels to individually fill each bag. Thereafter, the open end of each filled bag is hand tied, and the bags are transported to a location of need for subsequent individual placement by hand.

As is evident, the above-described sequence of events required for filled sandbag preparation and placement is not only physically exhausting, it is also time-consuming where time can well be a major consideration in avoiding a disaster. It is therefore apparent that a need is present for a faster, more efficient and more effective way of preparing and placing sandbag protection against water invasion. In view of this need, a primary object of the present invention is to provide a sandbag filler assembly and system wherein a length of sandbag can be filled on-site from a movable filler chute having surrounding its exterior an axially compressed sandbag which is released longitudinally in accord with filler material introduction to thereby form a continuous length of filled sandbag product.

Another object of the present invention is to provide methodology for generally continuously filling a length of sandbag by coordinating velocity of a movable filler chute with sandbag segment release from the chute as filler material in introduced into the sandbag.

Yet another object of the present invention is to provide a sandbag filler system wherein the filler chute and filler material source is mounted on a driveable vehicle.

These and other objects of the present invention will become apparent throughout the description thereof which now follows. SUMMARY OF THE INVENTION The present invention is a sandbag filler assembly for attachment to an axially movable filler-material source container. The assembly comprises a filler chute for delivery of filler material into the sandbag. The chute has a first open end and a second open end opposite the first end, with the first open end having an attachment connection connectable to be in flow communication with a delivery conduit of the filler-material source container. An axially compressible sandbag, open at one end and closed at an opposite end, is placeable in a compressed configuration around the filler chute such that the filler chute is within the sandbag with the closed end of the sandbag generally adjacent the second open end of the filler chute. An adjustable sandbag retainer is provided for selective retention and release of the sandbag from around the filler chute as the sandbag has introduced therein filler material to thereby cause sequential movement of sandbag segments from the filler chute.

Preferably, the filler chute additionally has a first segment in association with the first open end directed downwardly at a first downward angle and a second segment leading from the first segment at a second downward angle, wherein the first downward angle is greater than the second downward angle. This configuration provides aeration of filler material as it passes into the sandbag and additionally functions to reduce possible clogging of filler material as it proceeds through the chute.

A sandbag filler system includes the above described filler assembly in association with an axially movable filler-material source container having a delivery conduit through which filler material can flow. The container can be mounted on a vehicle which preferably can be a conventional cement delivery truck whose chute functions as the delivery conduit and whose revolving storage vessel is the container that carries the filler material.

Methodology for filling a sandbag incorporates placement of a compressed sandbag around the chute structure in communication with the second open end of the filler chute to thereby cause the filler material to flow through the delivery conduit while providing axial movement of the filler-material source container such that filler material enters the sandbag and simultaneously sequentially moves sandbag segments from the filler chute. Upon completion of filling, the open end of the resultant filled sandbag is tied or otherwise closed as known in the art. Coordination of filler-material flow rate with source-container velocity can result in substantially continuous filling activity. As is apparent, the present invention provides for rapid and semi-automatic production of filled sandbags of selected lengths which can be produced on-site to immediately follow surface topography and effectively render water invasion protection.

BRIEF DESCRIPTION OF THE DRAWINGS

An illustrative and presently preferred embodiment of the invention is shown in the accompanying drawings in which.

DETAILED DESCRIPTION OF THE PREFERRED EMBODIMENT

Figure 1:
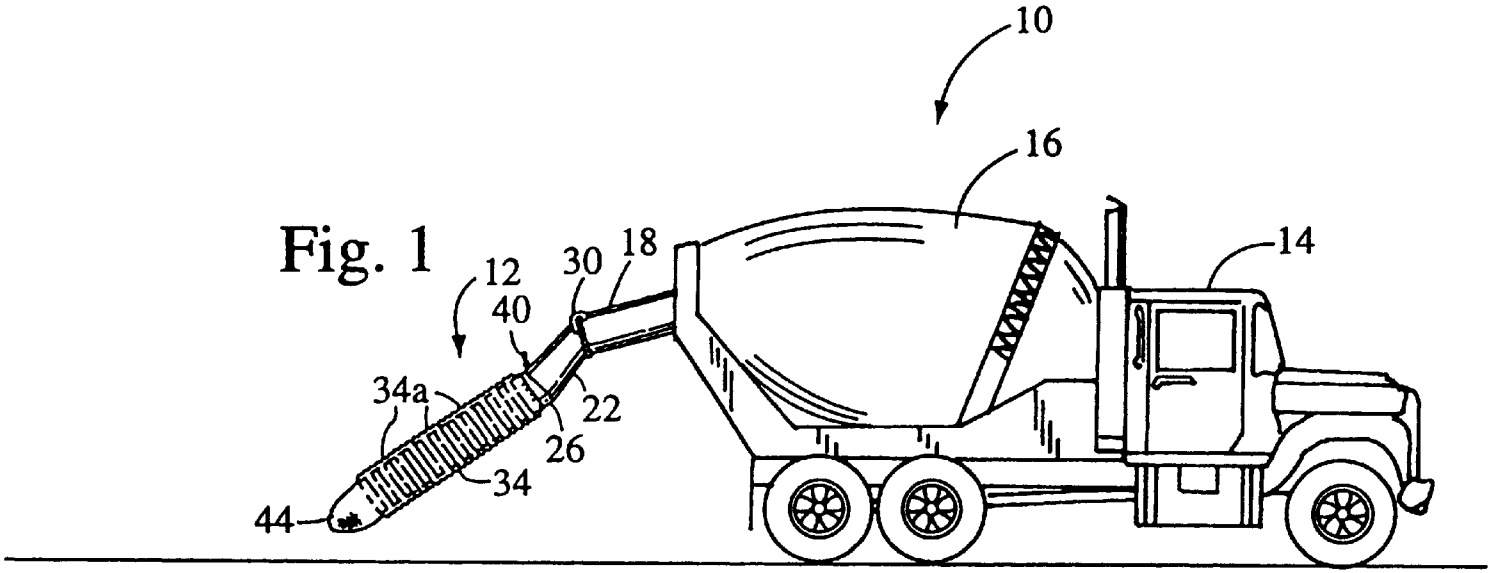
FIG. 1 is a side elevation view of a sandbag filler system for filling a sandbag with a filler material.
Figure 2:
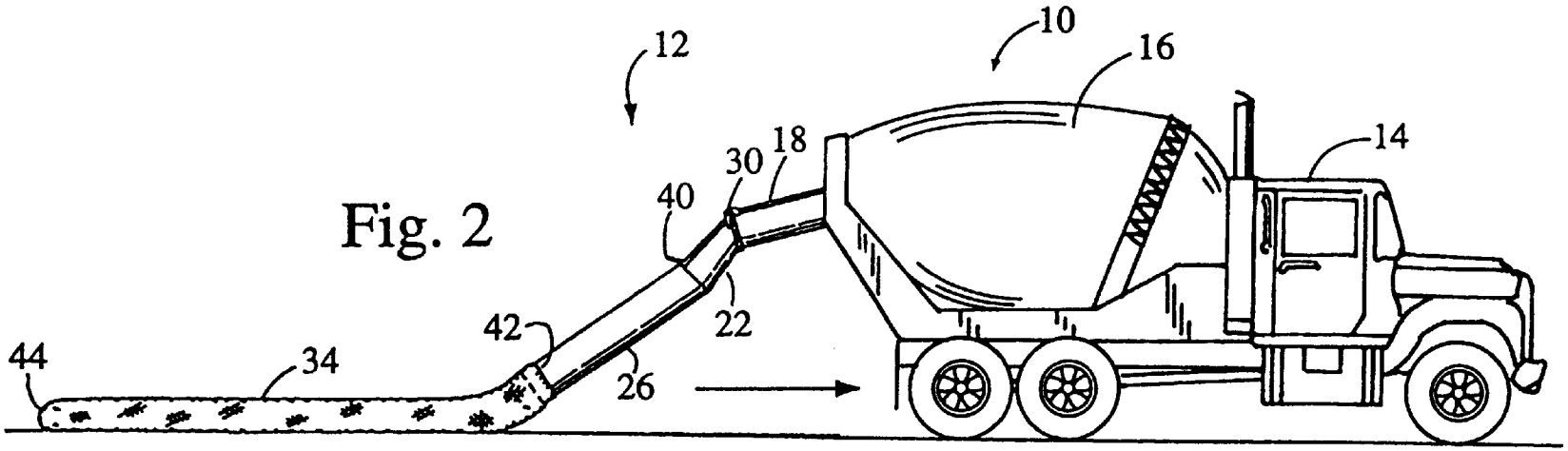
FIG. 2 is side elevation view as in FIG. 1 except with a filled sandbag positioned in place at a site.
Figure 3:
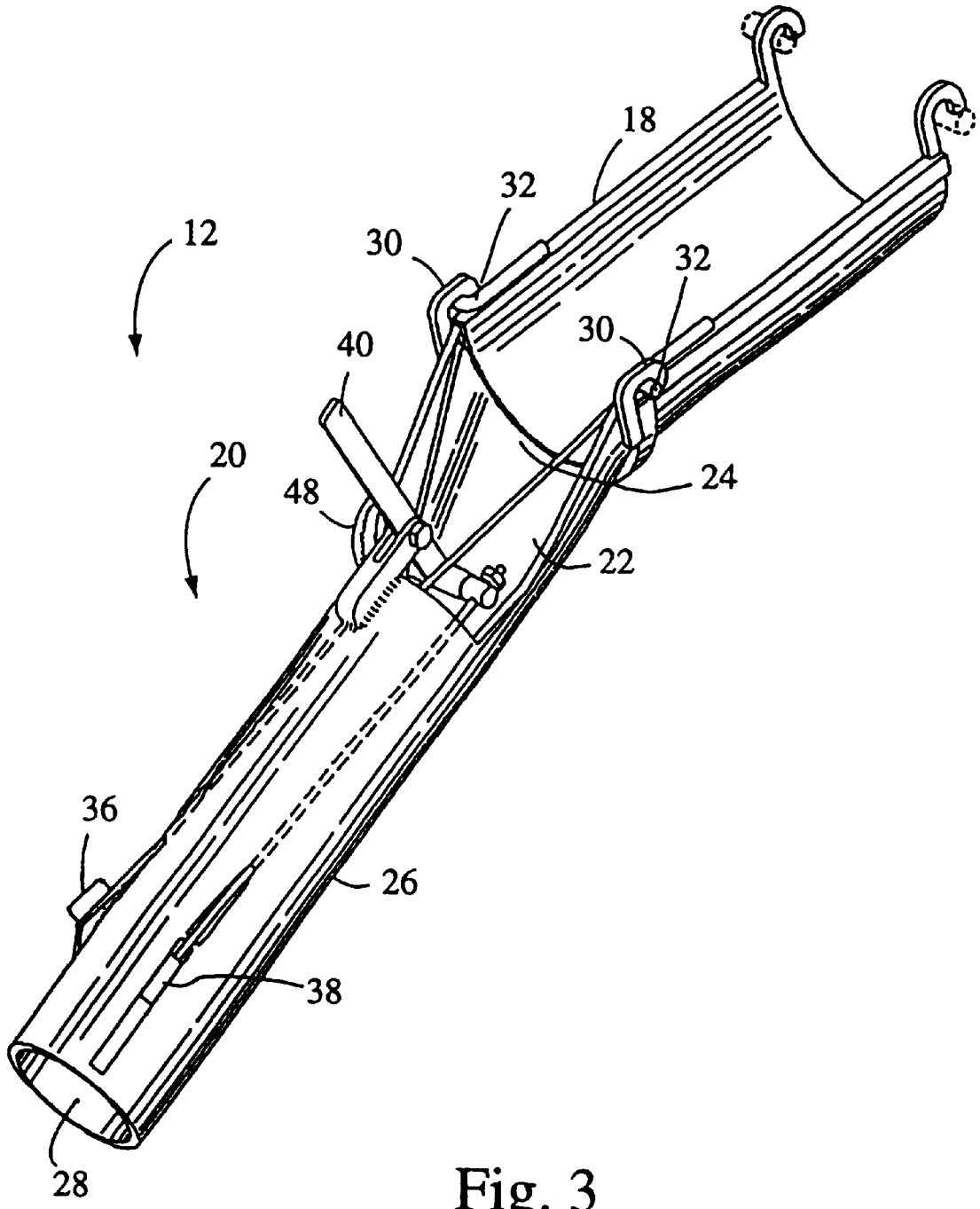
FIG. 3 is a perspective view of a filler chute for delivery of filter material into a sandbag.

Referring to FIGS. 1 and 2, a sandbag filler system 10 and sandbag filler assembly 12 are shown. The system 10 includes the sandbag filler assembly 12 and a driveable vehicle 14 such as a conventional concrete delivery truck whose rotating vessel serves as a filler-material source container 16 with a delivery conduit such as a conventional delivery chute 18. As more clearly shown in FIGS. 3–5, attached to the delivery chute 18 is a filler chute 20 having a first segment 22 in association with a first open end 24 of the filler chute 20 and directed downwardly at a first downward angle as shown. A second segment 26 of the filler chute 20 leads from the first segment 22 at a second downward angle to a second open end 28. As illustrated, the first downward angle is greater than the second downward angle to thereby promote aeration of filler material 46 (FIG. 4) as it passes into the filler chute 20 and additionally functions to reduce possible clogging of filler material 46 as it proceeds through the filler chute 20. The filler chute 20 is attached to the delivery chute 18 with conventional hooks 30 that engage complimentary laterally extending prongs 32.

Figure 4:
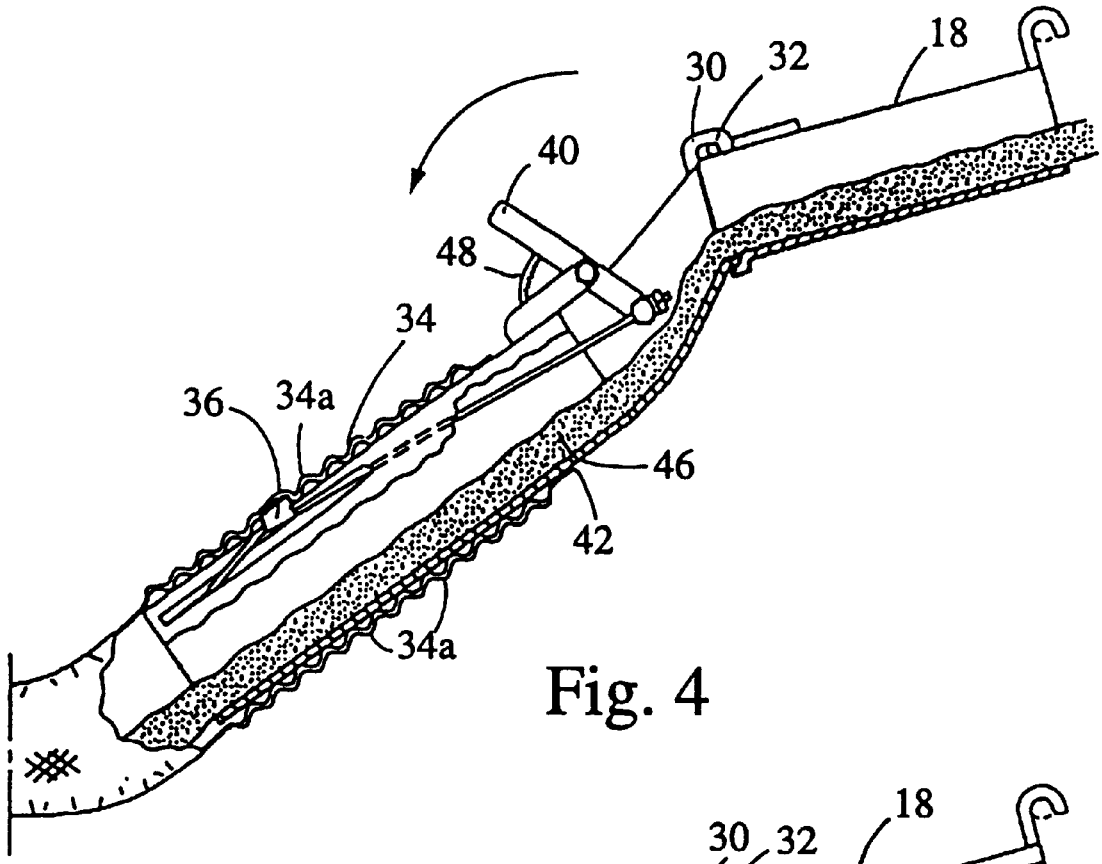
FIG. 4 is a side elevation view partially in cross section of a length of sandbag disposed on the filler chute of FIG. 3 and showing a sandbag retainer in an activated state.
Figure 5:
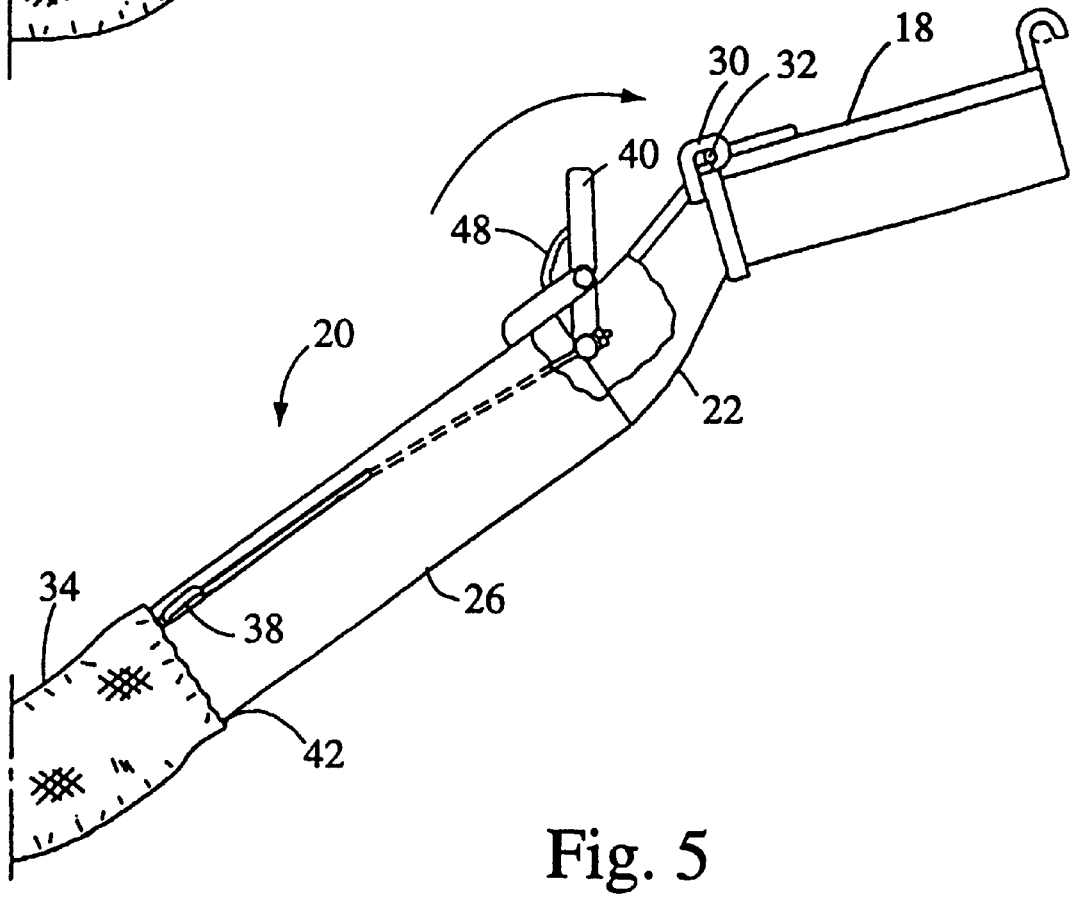
FIG. 5 is a side elevation view of the filler chute of FIG. 3 showing the sandbag retainer in a non-activated state.

FIGS. 1 and 4 show an axially compressed sandbag 34 in place around the filler chute 20. The sandbag 34 has an open end 42 and a closed end 44 generally adjacent the second open end 28 of the filler chute 20, and can be fabricated of any appropriate material. Preferably, it is constructed of synthetic burlap in a tubular shape as known in the art. Length of the sandbag 34 is limited only by needed coverage and practical placement. Such length can commonly, but nonlimitedly, be between about 10 feet and 200 feet, and preferably between about 100 feet and 150 feet. FIGS. 4 and 5 illustrate the manner in which the sandbag 34 is retained on and released from the filler chute 20. Specifically, two opposing skids 36, 38 are externally disposed on the filler chute 20. The skids 36, 38 are progressively movable laterally to engage with selective pressure thereon an inner surface of the sandbag 34 as sequential movement of sandbag segments 34*a* from the filler chute 20 occurs to thereby regulate sandbag segment movement rate. In the preferred embodiment, the skids 36, 38 also move rearwardly in a camlike path as illustrated, with skid movement selectively regulated by movement of a handle 40 whereby the skids 36, 38 are caused to move between an inactivated position (FIG. 5) and a fully activated position (FIG. 4), with selectable positions therebetween via a toothed arc 48 as known in the art. As is apparent, the greater the lateral movement of the skids 36, 38, the greater the pressure imposed on the inner surface of the sandbag 34 causing more force to be required to pull the bag material segments 34*a* from chute 20 thus allowing the operator to provide a more full or flater sandbag barrier as needed. The skids 36, 38 can be fabricated of any material having a surface that permits slippage of sandbag segments 34*a* thereon, including plastic, nylon, and the like.

In a preferred operation of the sandbag filler system 10, an operator first drives the vehicle 14 to a site where sandbag placement is desired. The sandbag filler assembly 12 is then attached to the vehicle 14 such that the delivery chute 18 and filler chute 20 are in communication as shown in FIGS. 1 and 2. An axially compressed sandbag 34 is situated around the filler chute 20 as shown in FIG. 1 such that the filler chute 20 is within the sandbag 34 with the closed end 44 thereof generally adjacent the second open end 28 of the filler chute 20. Filler material 46 is then made to flow from the rotating vessel (filler-material source container 16) through the delivery chute 18 to thereby cause the filler material 46 to flow to the filler chute 20. Axial movement of the vehicle 14 permits filler material 46 to enter the sandbag 34 and simultaneously sequentially moves sandbag segments 34*a* from the filler chute 20. Coordination of filler-material flow rate from the rotating vessel, vehicle velocity, and release of sandbag segments 34*a* controlled by lateral placement of the skids 36, 38 can result in a substantially continuous and relatively rapid filling activity that places a length of sandbag 34 as shown in FIG. 2 at a site of need. Upon such production, the open end 42 of the resultant filled sandbag is tied or otherwise closed.

While an illustrative and presently preferred embodiment of the invention has been described in detail herein, it is to be understood that the inventive concepts may be otherwise variously embodied and employed and that the appended claims are intended to be construed to include such variations except insofar as limited by the prior art.

What is claimed is:

1. A sandbag filler assembly for attachment to an axially movable filler-material source container, the assembly comprising:

a) a filler chute for delivery of filler material into a sandbag, with said filler chute having a first open end and a second open end opposite the first end, with said first open end having an attachment connection connectable to be in flow communication with a delivery conduit of the filler-material source container, said filler chute additionally having a first segment in association with the first open end directed downwardly at a first downward angle and a second segment leading from the first segment at a second downward angle to the second open end, wherein said first downward angle is greater than said second downward angle;

b) an axially compressible sandbag open at one end and closed at an opposite end, said sandbag being placeable in a compressed configuration around the filler chute such that the filler chute is within the sandbag with the closed end of the sandbar generally adjacent the second open end of the filler chute; and c) an adjustable sandbag retainer for selective retention and release of the sandbar from around the filler chute as said sandbar so situated has introduced therein filler material to thereby cause sequential movement of sandbag segments from the filler chute.

2. A sandbag filler assembly for attachment to an axially movable filler-material source container, the assembly comprising:

a) a filler chute for delivery of filler material into a sandbag, with said filler chute having a first open end and a second open end opposite the first end, with said first open end having an attachment connection connectable to be in flow communication with a delivery conduit of the filler-material source container, wherein said attachment connection comprises opposing lateral hooks engageable with respective cooperating hook acceptors disposed at the delivery conduit;

b) an axially compressible sandbag open at one end and closed at an opposite end, said sandbag being placeable in a compressed configuration around the filler chute such that the filler chute is within the sandbag with the closed end of the sandbag generally adjacent the second open end of the filler chute; and c) an adjustable sandbag retainer for selective retention and release of the sandbag from around the filler chute as said sandbag so situated has introduced therein filler material to thereby cause sequential movement of sandbag segments from the filler chute.

3. A sandbag filler assembly for attachment to an axially movable filler-material source container, the assembly comprising:

a) a filler chute for delivery of filler material into a sandbag, with said filler chute having a first open end and a second open end opposite the first end, with said first open end having an attachment connection connectable to be in flow communication with a delivery conduit of the filler-material source container;

b) an axially compressible sandbag open at one end and closed at an opposite end, said sandbag being placeable in a compressed configuration around the filler chute such that the filler chute is within the sandbag with the closed end of the sandbag generally adjacent the second open end of the filler chute; and c) an adjustable sandbag retainer for selective retention and release of the sandbar from around the filler chute as sandbag so situated has introduced therein filler material to thereby cause sequential movement of sandbag segments from the filler chute, wherein said sandbag retainer comprises an opposing pair of laterally movable skids externally disposed on the filler chute and progressively movable laterally to engage with selective pressure thereon an inner surface of the sandbag as sequential movement of sandbag segments from the filler chute occurs to thereby regulate sandbag segment movement rate.

4. A sandbag filler system for filling a sandbag with a filler material, the system comprising:

a) an axially movable filler-material source container having a delivery conduit through which filler material can flow; and b) a sandbag filler assembly for attachment to the filler-material source container, the assembly comprising:

1) a filler chute for delivery of filler material into a sandbag, with said filler chute having a first open end and a second open end opposite the first end, with said first open end having an attachment connection connectable to be in flow communication with the delivery conduit of the filler-material source container, with said filler chute additionally having a first segment in association with the first open end directed downwardly at a first downward angle and a second segment leading from the first segment at a second downward angle to the second open end, wherein said first downward angle is greater than said second downward angle;

2) an axially compressible sandbag open at one end and closed at an opposite end, said sandbag being placeable in a compressed configuration around the filler chute such that the filler chute is within the sandbag with the closed end of the sandbag generally adjacent the second open end of the filler chute; and 3) an adjustable sandbag retainer for selective retention and release of the sandbag from around the filler chute as said sandbar so situated has introduced therein filler material to thereby cause sequential movement of sandbar segments from the filler chute.

5. A sandbag filler system for filling a sandbag with a filler material, the system comprising:

a) an axially movable filler-material source container having a delivery conduit through which filler material can flow; and b) a sandbar filler assembly for attachment to the filler-material source container, the assembly comprising:

1) a filler chute for delivery of filler material into a sandbag, with said filler chute having a first open end and a second open end opposite the first end, with said first open end having an attachment connection connectable to be in flow communication with the delivery conduit of the filler-material source container, wherein the attachment connection comprises opposing lateral hooks engageable with respective cooperating hook acceptors disposed at the delivery conduit;

2) an axially compressible sandbar open at one end and closed at an opposite end, said sandbag being placeable in a compressed configuration around the filler chute such that the filler chute is within the sandbag with the closed end of the sandbag generally adjacent the second open end of the filler chute; and 3) an adjustable sandbag retainer for selective retention and release of the sandbag from around the filler chute as said sandbag so situated has introduced therein filler material to thereby cause sequential movement of sandbar segments from the filler chute.

6. A sandbag filler system for filling a sandbag with a filler material, the system comprising:

a) an axially movable filler-material source container having a delivery conduit through which filler material can flow; and b) a sandbag filler assembly for attachment to the filler-material source container, the assembly comprising:

1) a filler chute for delivery of filler material into a sandbag, with said filler chute having a first open end and a second open end opposite the first end, with said first open end having an attachment connection connectable to be in flow communication with the delivery conduit of the filler-material source container;

2) an axially compressible sandbag open at one end and closed at an opposite end, said sandbag being placeable in a compressed configuration around the filler chute such that the filler chute is within the sandbag with the closed end of the sandbag generally adjacent the second open end of the filler chute; and 3) an adjustable sandbar retainer for selective retention and release of the sandbag from around the filler chute as said sandbag so situated has introduced therein filler material to thereby cause sequential movement of sandbar segments from the filler chute, wherein the sandbag retainer comprises an opposing lair of laterally movable skids externally disposed on the filler chute and progressively movable laterally to engage with selective pressure thereon an inner surface of the sandbag as sequential movement of sandbag segments occurs to thereby regulate sandbag movement rate.

7. A method of filling a sandbag with a filler material, said method comprising:

a) providing an axially movable filler-material source container having therein a filler material and having a delivery conduit through which the filler material can flow;

b) providing a sandbag filler assembly attached to the filler-material source container, the assembly comprising:

1) a filler chute for delivery of filler material into a sandbag, with said filler chute having a first open end and a second open end opposite the first end, with said first open end having an attachment connection connected to be in flow communication with the delivery conduit of the filler-material source container; and 2) an axially compressed sandbag open at one end and closed at an opposite end, said sandbag placed in a compressed configuration around the filler chute such that the filler chute is within the sandbag with the closed end of the sandbag generally adjacent the second open end of the filler chute;

c) causing the filler material to flow through the delivery conduit while causing axial movement of the filler-material source container such that filler material enters the sandbag and simultaneously sequentially moves sandbag segments from the filler chute; and d) closing the open end of the sandbag upon completion of filler material flow.

8. A method of filling a sandbag as claimed in claim 7 wherein the filler chute has an adjustable sandbag retainer for selective retention and release of the tubular sandbag from around the filler chute as said sandbag so situated has introduced therein filler material to thereby cause sequential movement of sandbag segments from the filler chute, and wherein said sandbag retainer is adjusted to sequentially release sandbag segments in accord with speed of axial movement of the filler-material source container such that filler material introduction into the sandbag and sandbag segment release substantially coincide for substantially uniformly timed filler material introduction and sandbag segment release.

9. A method of filling a sandbag as claimed in claim 8 wherein the sandbag retainer comprises an opposing pair of laterally movable skids externally disposed on the filler chute and progressively movable laterally to engage with selective pressure thereon an inner surface of the sandbag as sequential movement of sandbag segments occurs to thereby regulate sandbag movement rate.

10. A sandbag filler system as claimed in claim 9 wherein the skids are fabricated of a plastic.

11. A method of filling a tubular sandbag as claimed in claim 7 wherein the axially movable filler-material source container is mounted on a vehicle.

12. A method of filling a sandbag as claimed in claim 7 wherein the filler chute additionally has a first segment in association with the first open end directed downwardly at a first downward angle and a second segment leading from the first segment at a second downward angle to the second open end, wherein said first downward angle is greater than said second downward angle.

13. A method of filling a sandbag as claimed in claim 7 wherein the sandbag is fabricated of a synthetic burlap fabric.

14. A method of filling a sandbag as claimed in claim 7 wherein the sandbag has a length between about 10 feet and 200 feet.

15. A method of filling a sandbag as claimed in claim 14 wherein the sandbag has a length between about 100 feet and 150 feet.

* * * * *